US008973172B2

(12) United States Patent
Daniel

(10) Patent No.: US 8,973,172 B2
(45) Date of Patent: Mar. 10, 2015

(54) NOISE SHIELD

(75) Inventor: Isaac Sayo Daniel, Miami, FL (US)

(73) Assignee: F3M3 Companies, Inc.

( * ) Notice: Subject to any disclaimer, the term of this patent is extended or adjusted under 35 U.S.C. 154(b) by 414 days.

(21) Appl. No.: 12/610,917

(22) Filed: Nov. 2, 2009

(65) Prior Publication Data

US 2011/0078844 A1 Apr. 7, 2011

Related U.S. Application Data

(63) Continuation-in-part of application No. 29/316,491, filed on Oct. 2, 2009, now Pat. No. Des. 633,658.

(51) Int. Cl.
*A42B 3/16* (2006.01)

(52) U.S. Cl.
CPC ..... *A42B 3/166* (2013.01)
USPC ..... 2/423; 2/410

(58) Field of Classification Search
USPC ..... 2/411, 425, 423, 422, 208, 209; 181/284, 294
See application file for complete search history.

(56) References Cited

U.S. PATENT DOCUMENTS

| | | | | |
|---|---|---|---|---|
| 3,423,759 | A * | 1/1969 | Hirsch et al. | 2/6.5 |
| 4,103,359 | A * | 8/1978 | Rieppel et al. | 2/8.1 |
| 4,979,586 | A * | 12/1990 | Lazzeroni et al. | 181/129 |
| 5,477,564 | A * | 12/1995 | Tichy | 2/423 |
| 5,477,565 | A * | 12/1995 | Hunt, Jr. | 2/423 |
| 5,632,048 | A * | 5/1997 | Mortell et al. | 2/423 |
| 5,860,166 | A * | 1/1999 | Ritts | 2/209 |
| 6,029,769 | A * | 2/2000 | Tichy | 181/136 |
| 6,073,272 | A * | 6/2000 | Ball | 2/423 |
| 6,272,692 | B1 * | 8/2001 | Abraham | 2/411 |
| 7,243,378 | B2 * | 7/2007 | Desarmaux et al. | 2/423 |
| 7,249,651 | B2 * | 7/2007 | Broersma | 181/129 |
| 7,328,462 | B1 * | 2/2008 | Straus | 2/411 |
| 7,475,434 | B2 * | 1/2009 | Ambuske et al. | 2/425 |
| 2006/0212998 | A1 * | 9/2006 | Gath | 2/423 |
| 2007/0266482 | A1 * | 11/2007 | Alexander et al. | 2/418 |

* cited by examiner

*Primary Examiner* — Andrew W Collins

(57) ABSTRACT

An apparatus comprising: a mount plate and at least one noise reduction element connected the mount plate. An article of head wear comprising: a shell having an upper portion and a lower open portion, at least one aperture located near the lower portion, and a noise reduction plate obstructing the at least one aperture. An article of head wear comprising: a shell having an upper portion and a lower portion, and a noise reduction element connected to the shell. A noise reduction element comprising: a frame having a framework, and a soundproofing element covering the framework. An apparatus comprising: a mount plate, and at least one aperture in the mount plate, wherein the aperture is formed to accommodate a noise reduction element.

8 Claims, 7 Drawing Sheets

NOISE SHIELD

PRIORITY CLAIM

The present application claims priority to, and is a Continuation in Part of U.S. Design Patent Application, application Ser. No. 29/316,491, titled "Noise Shield", filed Oct. 2, 2009 now U.S. Pat. No. Des. 633,658. The entire disclosure of said Design Patent Application is incorporated herein by reference.

FIELD

The present disclosure relates generally to noise reduction systems, and more particularly, to noise reduction systems for head wear.

BACKGROUND

Protective head wear has been used for thousands of years with such use being based on the idea of protecting a user's head from injury. The earliest forms of protective head wear were worn by military soldiers, who used such equipment to protect their heads against blows from various weapons, such as swords and arrows.

Although protective head wear is still used in modern military applications, other uses of protective head wear have evolved over the past several hundred years to include equipment for various recreational and civilian purposes, such as construction, mining, transportation, medical purposes, and sports. The use of protective head wear in sports has grown to be perhaps the most widespread, and includes sports such as American football, baseball, hockey, auto and motorcycle racing, rock climbing, lacrosse, skiing, equestrian sports, cricket, cycling, and other various types of sports.

The shape and size of protective head wear often times varies, and depends on the particular needs and circumstances of the purpose for which it will be applied. For example, a bicycle helmet may be designed to be well ventilated and aerodynamic, while a rock climbing helmet may be designed to be lightweight and less-bulky.

In some applications, an article of protective head wear, such as a helmet, includes a portion that covers and, in some cases, extends below the user's ear. Examples of this design include American football helmets, baseball helmets, and auto racing helmets.

Traditionally, the portion that covers the user's ear may include an aperture so that the user is still able to hear outside sound while wearing the helmet. In some cases, however, the portion that covers the user's ear is solid, and does not include an aperture near the ear; in this case the user may have trouble hearing outside sounds, if he or she is able to hear them at all.

Where the protective head wear includes an aperture near the user's ear, noise is able to enter into the user's ear, and in some cases may cause discomfort and hamper the user's ability to perform various functions. A sport in which this problem often arises is American football. American football helmets are traditionally designed with a portion of the helmet extending over and below the user's ear, and include an aperture near the user's ear. American football players often times experience confusion on the field due to crowd noise, which is able to enter through the above mentioned aperture.

In instances where a user may want to hear an outside sound, but where the protective head wear does not include an aperture near the user's ear, the user may have trouble hearing the sound.

SUMMARY

The apparatuses described herein result from the realization that protective head wear may be fitted with equipment, such as a plate that fits over a user's ear and accommodates a noise reduction element, which allows the user to choose whether to block outside noise by inserting the noise reduction element, or to allow the noise to penetrate the protective head wear by removing the noise reduction element.

The apparatuses described herein result from the further realization that protective head wear may be manufactured with an aperture near the user's ear, which may accommodate a noise reduction element, which, in turn, allows the user to choose whether to block outside noise by inserting the noise reduction element, or to allow the noise to penetrate the protective head wear by removing the noise reduction element.

The apparatuses described herein result from the further realization that a noise reduction element may be provided to a user of protective head wear so that the user may insert the noise reduction element in an aperture of the protective head wear so as to block outside noise.

DETAILED DESCRIPTION OF PREFERRED EMBODIMENTS

Figure 1A:
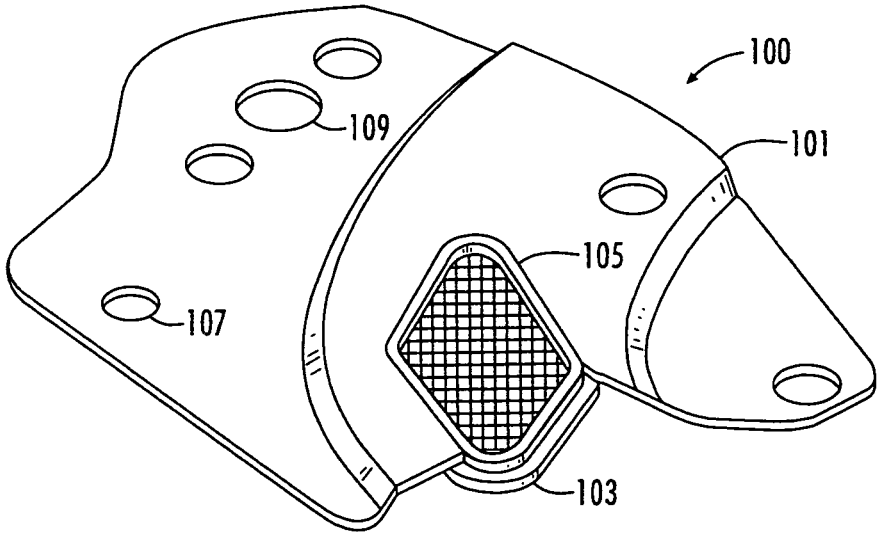
FIG. 1A shows an apparatus in accordance with one embodiment.
Figure 1B:
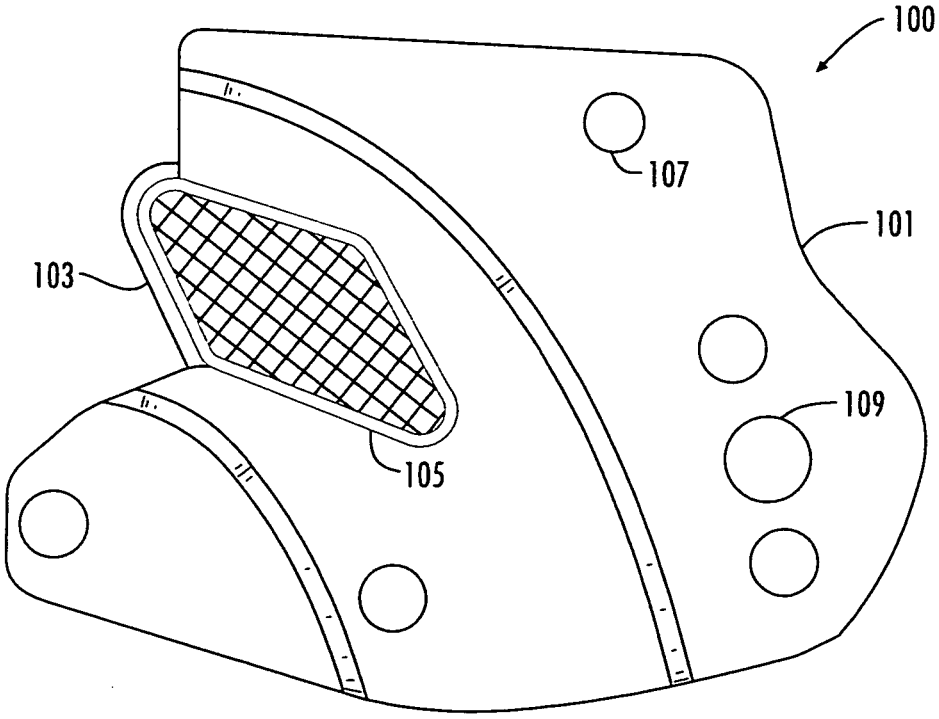
FIG. 1B shows an apparatus in accordance with one embodiment.
Figure 1C:
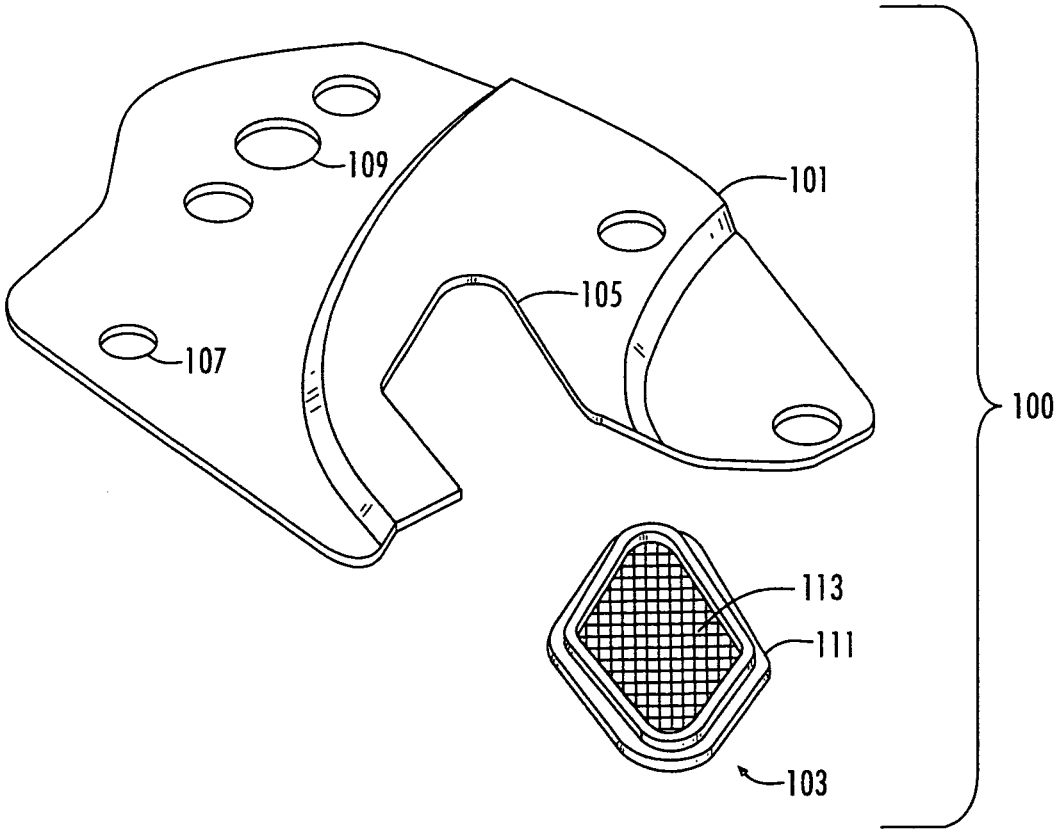
FIG. 1C shows an apparatus in accordance with one embodiment.

FIGS. 1A through 1C show a noise reduction plate 100 in accordance with one embodiment. Noise reduction plate 100 comprises a mount plate 101 and at least one noise reduction element 103 connected to mount plate 101.

Mount plate 101 may be formed of any material with requisite stiffness to allow it to be mounted to a secondary surface. Such materials may include, but are not limited to, plastic, resin, metal, carbon fiber, and fiberglass.

Figure 5A:
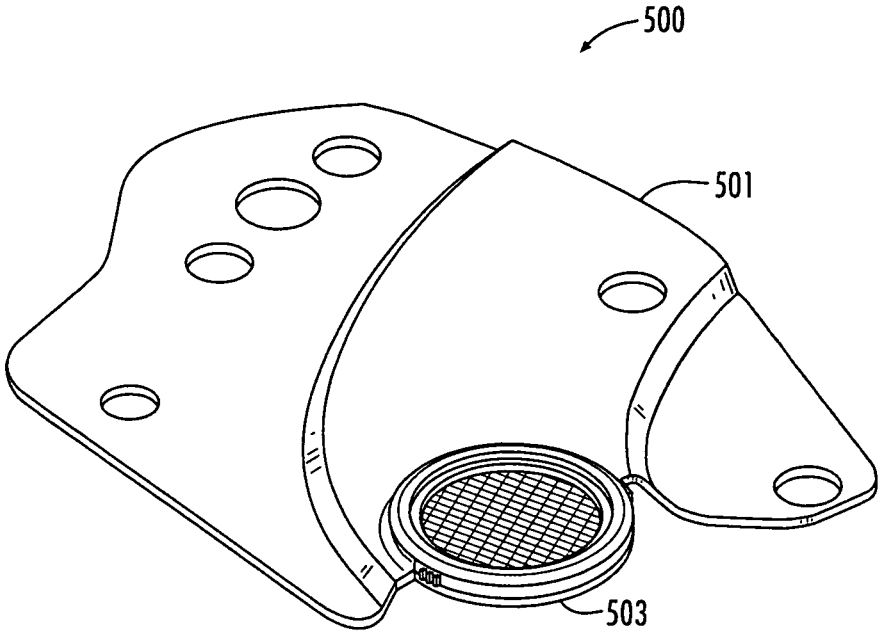
FIG. 5A shows an embodiment of an apparatus in accordance with one embodiment.
Figure 5B:
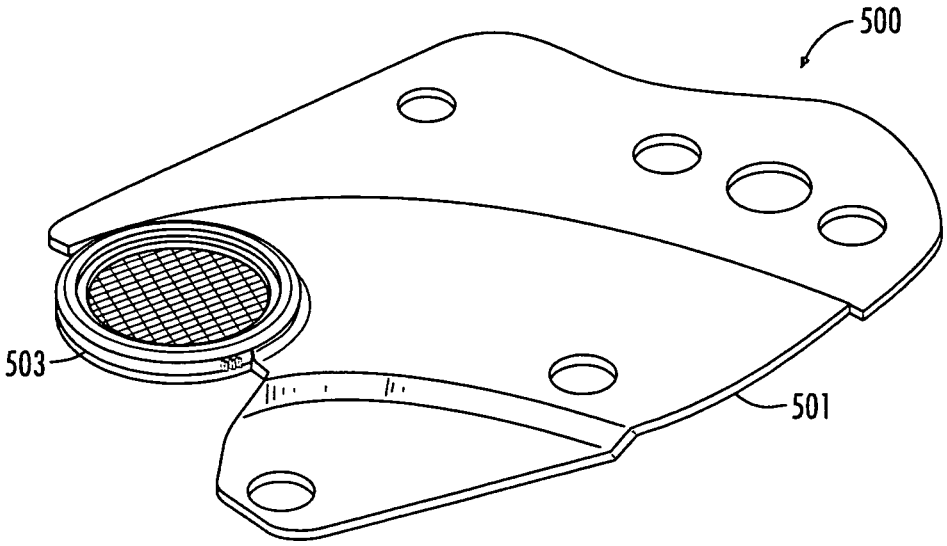
FIG. 5B shows an embodiment of an apparatus in accordance with one embodiment.
Figure 5C:
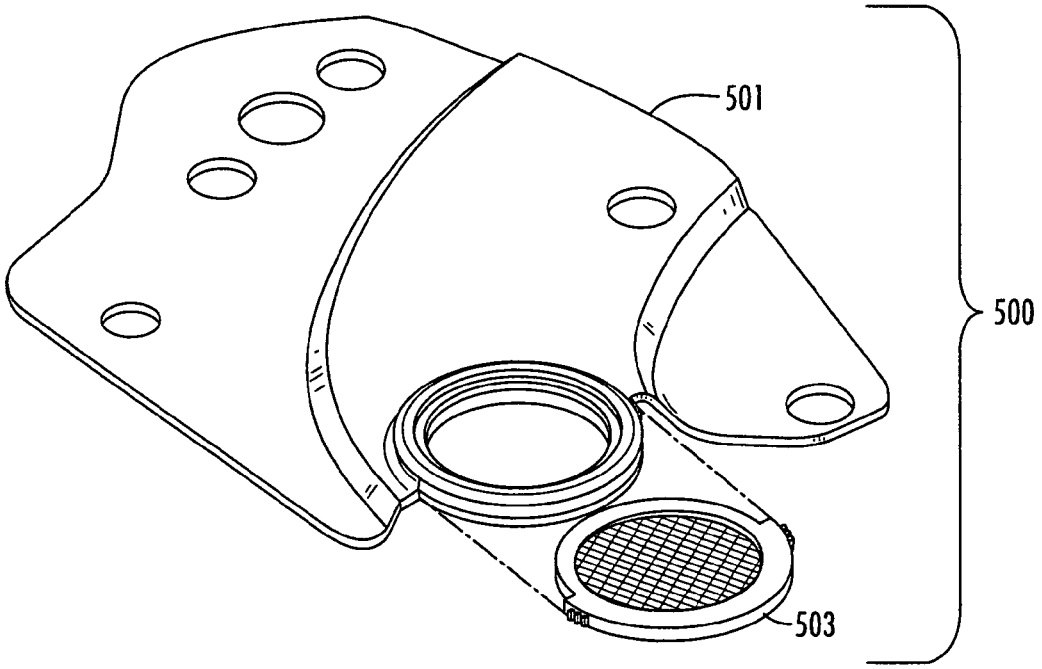
FIG. 5C shows an embodiment of an apparatus in accordance with another embodiment.

In some embodiments, mount plate 101 may include at least one aperture 105, wherein noise reduction element 103 may be inserted. In other embodiments, aperture 105 may be a slot wherein noise reduction element 103 is inserted. Aperture 105 may be any shape, such as, but not limited to, a rectangle, a circle (as shown in FIGS. 5A, 5B, and 5C), a triangle, and the like.

In further embodiments, mount plate 101 may include a means for mounting the mount plate to a secondary surface. Such a secondary surface may include, but is not limited to, the surface of an article of protective head wear, which may include, but is not limited to, the shell of a helmet. In one embodiment, the means for mounting the mount plate may include at least one aperture 107, through which the mount plate may be fastened to the secondary surface. The means for mounting the mount plate may include other means, such as, but not limited to, a buckle, a button, a magnet, a thread, a clip, a hooks-and-loops fastener, a zipper, glue, sticky tack, or any other means of holding two surfaces together.

In yet another embodiment, mount plate 101 may include an aperture 109, which allows an object located on the secondary surface to protrude through aperture 109. An exemplary embodiment may be a helmet which has a means for mounting a foreign object, such as a push button fastener, extending from the surface of the helmet. Such a fastener may be used for a variety of purposes, such as attaching a chin strap or a facemask, to the helmet. In such an embodiment, a user may want the fastener to extend through mount plate 101 so that it could be used to fasten to the foreign object to the helmet notwithstanding the fact that mount plate 101 is also connected to the helmet. Aperture 109 may allow the foreign object and mount plate 101 to be simultaneously connected to the secondary surface by allowing the secondary surface's means for mounting the foreign object to protrude through mount plate 101. Should it be the foreign object that has the means for mounting itself to the secondary surface, aperture 109 may allow for a similar result. In an alternate embodiment, mount plate 101 includes a means for mounting a foreign object (not shown). In yet another embodiment, the means for mounting a foreign object may be the same means for mounting the mount plate 101, e.g., the means for mounting the foreign object may also hold mount plate 101 in place.

In another embodiment, noise reduction element 103 is detachably connected to mount plate 101. Such detachability may be achieved by providing an aperture 105, such as a slot, in mount plate 101, wherein noise reduction element may be inserted. In some embodiments, noise reduction element 103 may be detachably connected via a fastener, such as, but not limited to, a buckle, a button, a magnet, a thread, a clip, a hooks-and-loops fastener, a zipper, glue, sticky tack, or any other means of attaching one object to another. Noise reduction element 103 may be of any shape, including, but not limited to, a square, rectangle, triangle, circle (as shown in FIGS. 5A, 5B, and 5C), semi-circle, parallelogram, and trapezoid, amongst others.

In another embodiment, noise reduction element 103 may be connected directly to an article of head wear, such as those embodiments described with reference to FIG. 4 below. In other embodiments, noise reduction element 103 may be detachably connected directly to an article of head wear, such as those embodiments described with reference to FIG. 4 below.

In one embodiment, noise reduction element 103 comprises a frame 111 having framework, and a soundproofing element 113 covering the framework.

In a further embodiment, soundproofing element 113 may be a noise insulating material. In yet a further embodiment, soundproofing element 113 may be a soundproofing material, including, but not limited to, soundproofing foam, such as memory foam and acoustic foam, polystyrene foam, neoprene, or silicone. In another embodiment, soundproofing element 113 may be formed of a solid material, including, but not limited to, plastic, resin, metal, carbon fiber, wood, or fiberglass.

In another embodiment, noise reduction element 103 may include a noise cancellation unit, such as a noise cancellation device, which may employ technology similar to that used in noise cancellation headphones.

Figure 2A:
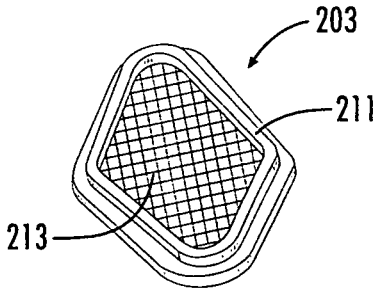
FIG. 2A shows a noise reduction element in accordance with one embodiment.

FIG. 2A shows a noise reduction element 203 in accordance with one embodiment. Noise reduction element 203 comprises a frame 211 having a framework, and a soundproofing element 213 covering the framework.

In some embodiments, noise reduction element 203 may be connected directly to an article of head wear, such as those embodiments described with reference to FIG. 4 below. In other embodiments, noise reduction element 203 may be detachably connected directly to an article of head wear, such as those embodiments described with reference to FIG. 4 below. Noise reduction element 203 may be of any shape, including, but not limited to, a square, rectangle, triangle, circle (as shown in FIGS. 5A, 5B, and 5C), semi-circle, parallelogram, and trapezoid, amongst others.

In a further embodiment, soundproofing element 213 may be a noise insulating material. In yet a further embodiment, soundproofing element 213 may be a soundproofing material, including, but not limited to, soundproofing foam, such as memory foam and acoustic foam, polystyrene foam, neoprene, or silicone. In another embodiment, soundproofing element 113 may be formed of a solid material, including, but not limited to, plastic, resin, metal, carbon fiber, wood, or fiberglass.

In another embodiment, noise reduction element 203 may include a noise cancellation unit, such as a noise cancellation device, which may employ technology similar to that used in noise cancellation headphones.

Figure 2B:
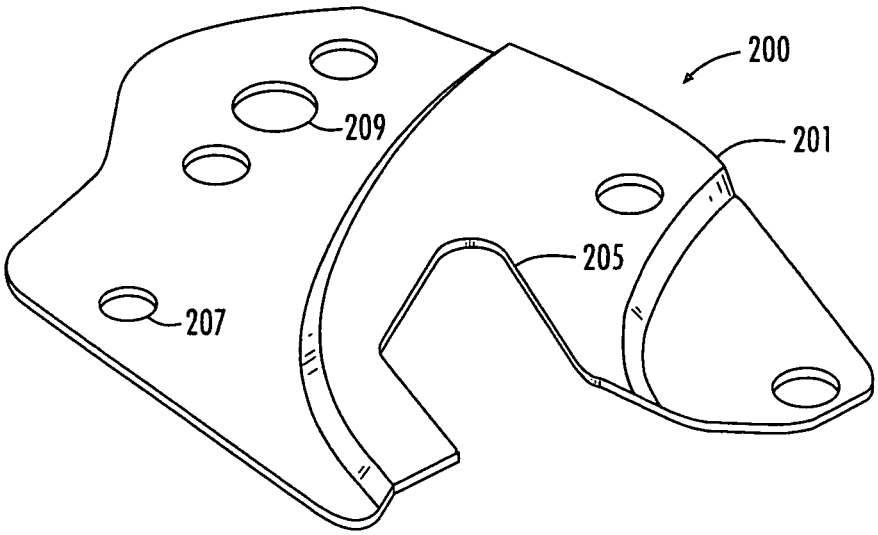
FIG. 2B shows an apparatus in accordance with yet another embodiment.

FIG. 2B shows an apparatus 200, in accordance with one embodiment. In one embodiment, apparatus 200 comprises a mount plate 201, and at least one aperture 205 in mount plate 201, wherein one of the least one aperture 205 is formed to accommodate a noise reduction element (as shown in FIGS. 1A-1C, with reference to numeral 103).

Mount plate 201 may be formed of any material with requisite stiffness to allow it to be mounted to a secondary surface. Such materials may include, but are not limited to, plastic, resin, metal, carbon fiber, and fiberglass.

In some embodiments, aperture 205 may be a slot wherein the noise reduction element is inserted. Aperture 205 may be any shape, such as, but not limited to, a rectangle, a circle (as shown in FIGS. 5A, 5B, and 5C), a triangle, and the like.

In further embodiments, mount plate 201 may include a means for mounting the mount plate to a secondary surface. Such a secondary surface may include, but is not limited to, the surface of an article of protective head wear, which may include, but is not limited to, the shell of a helmet. In one embodiment, the means for mounting the mount plate may include at least one aperture 207, through which the mount plate may be fastened to the secondary surface. The means for mounting the mount plate may include other means, such as, but not limited to, a buckle, a button, a magnet, a thread, a clip, a hooks-and-loops fastener, a zipper, glue, sticky tack, or any other means of holding two surfaces together.

In yet another embodiment, mount plate 201 may include an aperture 209, which allows an object located on the secondary surface to protrude through aperture 209. An exemplary embodiment may be a helmet which has a means for mounting a foreign object, such as a push button fastener, extending from the surface of the helmet. Such a fastener may be used for a variety of purposes, such as attaching a chin strap or a facemask, to the helmet. In such an embodiment, a user may want the fastener to extend through mount plate 201 so that it could be used to fasten to the foreign object to the helmet notwithstanding the fact that mount plate 201 is also connected to the helmet. Aperture 209 may allow the foreign object and mount plate 201 to be simultaneously connected to the secondary surface by allowing the secondary surface's means for mounting the foreign object to protrude through mount plate 201. Should it be the foreign object that has the means for mounting itself to the secondary surface, aperture 209 may allow for a similar result. In an alternate embodiment, mount plate 201 includes a means for mounting a foreign object (not shown). In yet another embodiment, the means for mounting a foreign object may be the same means for mounting the mount plate 201, e.g., the means for mounting the foreign object may also hold mount plate 201 in place.

Figure 3:
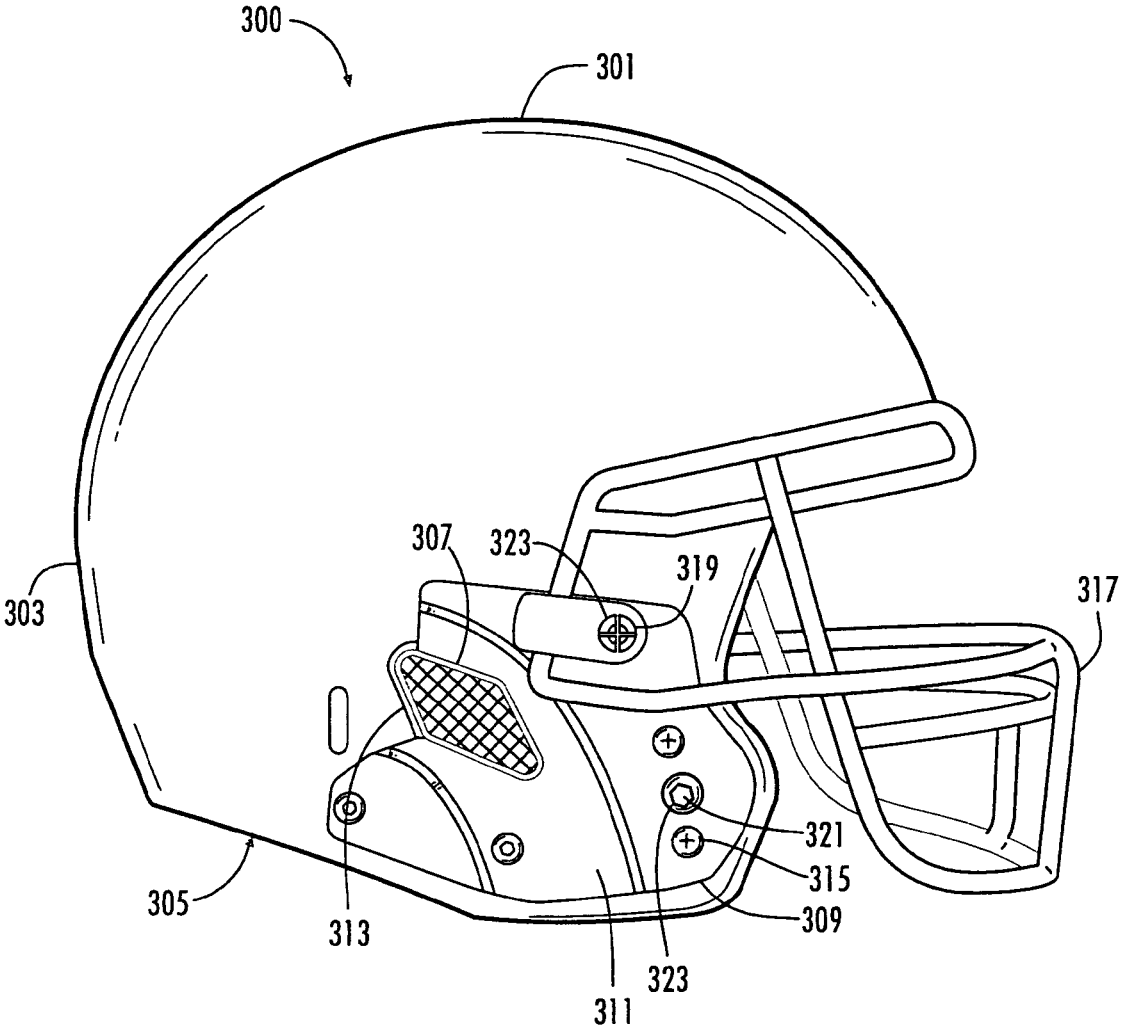
FIG. 3 shows an article of head wear in accordance with one embodiment.

FIG. 3 shows an article of head wear 300 in accordance with one embodiment. Article 300 comprises a shell 301, having an upper portion 303, and a lower portion 305, at least one aperture 307 (not currently shown) near lower portion 305, and a noise reduction plate 309 obstructing the at least one aperture 307. In some embodiments, upper portion 303 may be a closed upper portion, and lower portion 305 may be an open lower portion.

In some embodiments, article 300 may be a helmet, such as, but not limited to, an American football helmet, baseball helmet, hockey helmet, auto or motorcycle racing helmet, rock climbing helmet, lacrosse helmet, skiing helmet, equestrian sports helmet, cricket helmet, cycling helmet, and military issue helmet, amongst others. In further embodiments, article 300, including shell 301, may be formed of a solid material, including, but not limited to, plastic, resin, metal, carbon fiber, wood, or fiberglass.

In some embodiments, a user of article 300 may insert their head through lower portion 305 and into upper portion 303, with the majority of their head being protected by upper portion 303.

In further embodiments, aperture 307 may allow outside noise or sound to enter article 300, thereby allowing a user of article 300 to hear the outside noise or sound. In some embodiments, aperture 307 may be positioned near the location where a user's ear may be located when using article 300. In certain cases, allowing the user of article 300 to hear outside noise may be desirable, such as in the sport of American football, where players often verbally communicate to each other, and thus need to hear each other through their helmets. On the other hand, there are times when players need to block out ambient noises in order to concentrate, such as during live games, where loud crowd noises may cause confusion.

In some embodiments, noise reduction plate 309 comprises a mount plate 311 and a noise reduction element 313 connected to mount plate 311. In one embodiment, noise reduction plate 309 is detachably connected to shell 301 of article 300. In another embodiment, noise reduction plate 309 is detachably connected to shell 301 of article 300 via at least one means 315 for connecting noise reduction plate 309 to shell 301. In one embodiment, the means 315 for connecting noise reduction plate 309 to shell 301 may include at least one aperture positioned on mount plate 311, through which mount plate 311 may be fastened to shell 301. In other embodiments, the means 315 for connecting noise reduction plate 309 may include other means, such as, but not limited to, a buckle, a button, a magnet, a thread, a clip, a hooks-and-loops fastener, a zipper, glue, sticky tack, or any other means of holding two surfaces together.

In some embodiments, article 300 may include additional equipment, such as a facemask 317, or a chinstrap (not shown). In one embodiment, the additional equipment may be attached to article 300 via a connecting means, such as a fastener 319, 321. In such an embodiment, a user may want the fastener to extend through noise reduction plate 309 so that it could be used to fasten the additional equipment to article 300 notwithstanding the fact that noise reduction plate 309 is also connected to article 300. In some embodiments, at least one aperture 323 may allow the additional equipment and noise reduction plate 309 to be simultaneously connected to article 300 by allowing the connecting means for connecting the additional equipment to protrude through noise reduction plate 309. In some embodiments, aperture 323 is located in mount plate 311. In an alternate embodiment, noise reduction plate 309 includes a means for connecting the additional equipment (not shown). In yet another embodiment, the means for connecting the additional equipment may be the same means for connecting noise reduction plate 309 to article 300.

Figure 4:
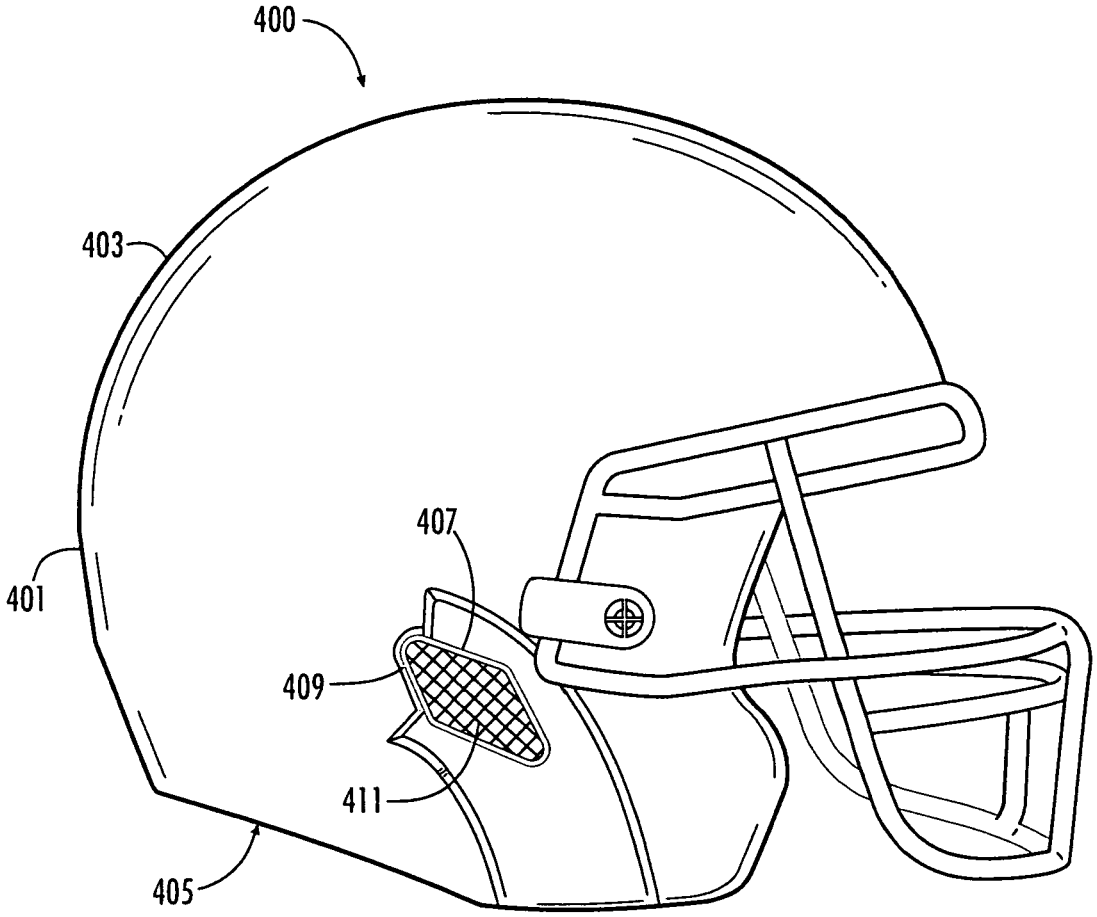
FIG. 4 shows an article of head wear in accordance with another embodiment.

FIG. 4 shows an embodiment of an article of head wear 400. In some embodiments, article 400 comprises a shell 401 having an upper portion 403 and a lower portion 405, and a noise reduction element 409 connected to shell 401. In some embodiments, noise reduction element 409 may be detachably connected to shell 401. Such detachability may be achieved by providing an aperture 407, such as a slot, in shell 401, wherein noise reduction element 409 may be inserted. In some embodiments, noise reduction element 409 may be detachably connected via a fastener, such as, but not limited to, a buckle, a button, a magnet, a thread, a clip, a hooks-and-loops fastener, a zipper, glue, sticky tack, or any other means of attaching one object to another. Noise reduction element 409 may be any shape, such as, but not limited to, a square, a circle (as shown in FIGS. 5A, 5B, and 5C), a triangle, and the like.

In some embodiments, noise reduction element 409 may be of any shape, including, but not limited to, a square, rectangle, triangle, circle (as shown in FIGS. 5A, 5B, and 5C), semicircle, parallelogram, and trapezoid, amongst others.

In a further embodiment, noise reduction element 409 may include soundproofing element 411. In some embodiments, soundproofing element 411 may be a noise insulating material. In yet a further embodiment, soundproofing element 411 may be a soundproofing material, including, but not limited to, soundproofing foam, such as memory foam and acoustic foam, polystyrene foam, neoprene, or silicone. In another embodiment, soundproofing element 411 may be formed of a solid material, including, but not limited to, plastic, resin, metal, carbon fiber, wood, or fiberglass.

In another embodiment, noise reduction element 409 may include a noise cancellation unit, such as a noise cancellation device, which may employ technology similar to that used in noise cancellation headphones.

FIGS. 5A, 5B, and 5C show an embodiment of an apparatus 500. Apparatus 500 comprises a mount plate 501 and a noise reduction element 503. In some embodiments, mount plate 501 may be similar to the various embodiments described with reference to numerals 101, 201, and 311 in FIGS. 1A through 3. In other embodiments, noise reduction element 503 may be similar to the various embodiments described with reference to numerals 103, 203, 313, and 409 in FIGS. 1A through 4.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. An article of head wear comprising:

a shell having a upper portion and a lower portion;

at least one aperture located near the lower portion; and a noise reduction plate obstructing the at least one aperture, wherein the noise reduction plate comprises:

at least one noise reduction element having a first edge; said noise reduction element further comprising a frame having framework, said noise reduction element further comprising a sound proofing element separate from the frame having framework, wherein the sound proofing element covers the framework; and a mount plate having an outer edge wherein at least a portion of the outer edge of the mount plate is substantially similar in contour to at least a portion of the noise reduction element's first edge, and wherein the outer edge of the mount plate is formed to slideably receive the noise reduction element and engage with at least a portion of the first edge of the noise reduction element, wherein a surface of the noise reduction element is substantially even with a surface of the mount plate when the noise reduction element is slideably engaged with the mount plate.

2. The article of head wear of claim 1, wherein the noise reduction element comprises a lip that runs along and below the first edge of the noise reduction element, such that a surface of the lip abuts a surface of the mount plate when the noise reduction element is slideably engaged with the mount plate.

3. The article of head wear of claim 1, wherein the noise reduction element is detachably connected to the mount plate.

4. The article of head wear of claim 1, wherein the mount plate comprises at least one elevated portion, wherein the elevated portion comprises the portion of the mount plate's edge that slideably engages with the noise reduction element's first edge.

5. The article of head wear of claim 4, wherein the elevated portion is elevated to a height that is equal to or greater than a height of the noise reduction element.

6. The article of head wear of claim 1, wherein the shell is the shell of an American football helmet.

7. An article of head wear comprising:

a noise reduction element having an outer edge, the noise reduction element comprising a frame having framework, the noise reduction element further comprising a sound proofing element separate from the frame having framework, wherein the sound proofing element covers the framework; and a shell comprising a main surface and a raised surface, wherein the raised surface comprises an open edge along at least a portion of an outer edge of the raised surface, wherein at least a portion of the open edge is substantially similar in contour to at least a portion of the noise reduction element's outer edge, and wherein the open edge of the raised surface is formed to slideably receive the noise reduction element and engage with at least a portion of the outer edge of the noise reduction element, wherein a surface of the noise reduction element is substantially even with the raised surface of the shell when the noise reduction element is slideably engaged with the shell.

8. The article of head wear of claim 7, wherein the noise reduction element is detachably connected to the shell.

* * * * *